US005678811A

United States Patent [19]

Johnson

[11] Patent Number: 5,678,811

[45] Date of Patent: Oct. 21, 1997

[54] STACKED LUMBER CLAMP

[75] Inventor: Steven Johnson, Bishop, Calif.

[73] Assignee: Steven C. Johnson, Bishop, Calif.

[21] Appl. No.: 429,349

[22] Filed: Apr. 26, 1995

[51] Int. Cl.[6] ..... B25B 1/04

[52] U.S. Cl. ..... 269/237; 211/8; 211/49.1; 248/507

[58] Field of Search ..... 144/306; 269/237; 211/8, 49.1; 248/507, 510, 676

[56] References Cited

U.S. PATENT DOCUMENTS

| | | | |
|---|---|---|---|
| 1,488,868 | 4/1924 | Crimmins | 269/237 |
| 1,558,929 | 10/1925 | Schmutz | 269/237 |
| 2,024,112 | 12/1935 | Phillis | 269/237 |
| 2,747,576 | 5/1956 | Bronstein | 269/237 |
| 3,107,910 | 10/1963 | Wiemken | 269/237 |
| 3,553,700 | 1/1971 | Brooker | 269/237 |

*Primary Examiner*—W. Donald Bray
*Attorney, Agent, or Firm*—Timothy T. Tyson

[57] ABSTRACT

A clamp (30) for clamping stacked lumber (72) to prevent twisting and bending of the lumber or theft is disclosed. A horizontal member (36) goes under the lumber and is attached to a vertical member (32) at the back. A pressure bar (42) hinged to the vertical member goes on top of the lumber. A brace (52) between the front of the pressure bar and the vertical member exerts pressure to hold the lumber in place.

17 Claims, 6 Drawing Sheets

FIG. 7
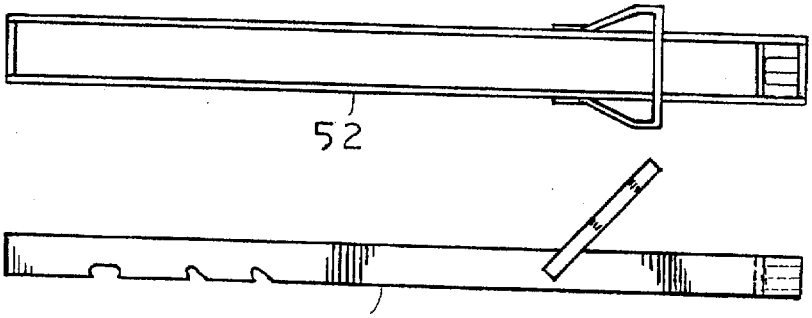
FIG. 8
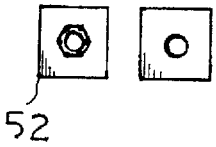
FIG. 9
FIG. 6
FIG 5
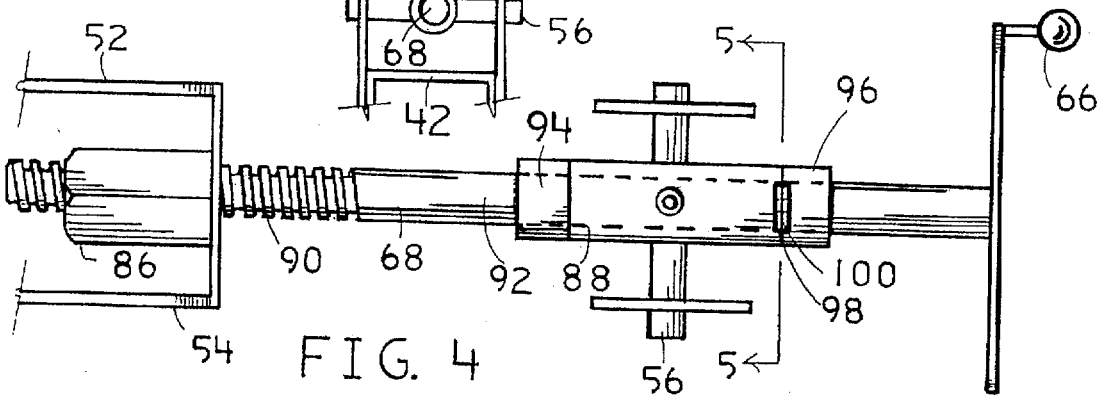
FIG. 4
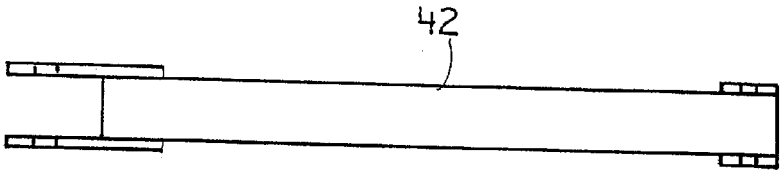
FIG. 12
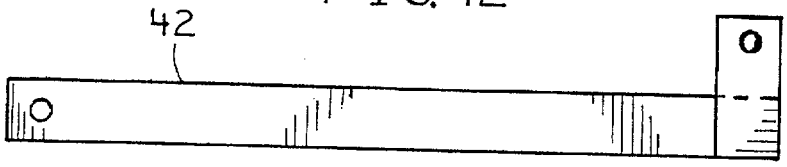
FIG. 11
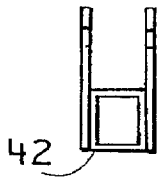
FIG. 13

STACKED LUMBER CLAMP

TECHNICAL FIELD

The present invention pertains to lumber clamps, and more particularly to a large clamp for holding a stack of lumber in place to keep the boards from twisting and bending as they dry.

BACKGROUND ART

Several devices for stacking and holding lumber to keep it from twisting and bending have been developed. The problem is particularly acute with green lumber which has recently been cut and has a high water content. Once a board has become twisted or bent, it is difficult or impossible to use. Losses of 20–30% of the boards in a stack of lumber to twisting or bending are not uncommon. The solution is to hold the stack of lumber or to lay the boards in special racks so they cannot twist or bend. Then as they dry, they dry straight.

U.S. Pat. No. 2,181,356 describes the problem and shows a rack for storing piled lumber at an angle in order to minimize the "crooking, splitting, bowing, checking, and cupping" of the lumber as it dries. A reduction in the loss of lumber to these factors from 20% to 1% is claimed. One problem with the rack is that the boards must be carefully inserted into the rack one at a time which is time consuming and expensive. The lumber comes from the sawmill in rectangular stacks with the boards laid horizontally. If the rack is to be used, the stacks must be broken down and the boards inserted into the rack individually. Another problem with the rack is that each different size of lumber requires different notched base supports in order to hold the boards at the proper angle. The rack in U.S. Pat. No. 2,247,519 also holds the lumber at an angle in order to use the force of gravity to hold each board both vertically and horizontally to keep it straight.

U.S. Pat. No. 3,504,404 discloses a device for holding stacked lumber in place during movement of the stack for shipment and could be used to hold lumber during storage as it dries although access would be awkward requiring removal of a top chain or beam. A somewhat similar arrangement is shown in U.S. Pat. No. 4,107,958 which is designed to protect large sheets of building materials from theft by the use of side clamps. U.S. Pat. No. 4,730,734 discloses another clamping device for protecting building materials or other goods from theft. The horizontal clamping bars are held on a vertical column which keeps them out of the way of the lumber or other goods when they are lifted.

None of the prior art rack devices provides retention of a unit stack of lumber to keep the boards straight. None of the prior art clamping devices provides easy application to a stack of lumber while allowing quick access to the lumber when lifted.

DISCLOSURE OF INVENTION

The present invention is directed to a clamp for a stack of lumber which is easily applied when desired and lifted for access to the top pieces of lumber. A horizontal member of the main stand goes under the lumber and is attached to a vertical member at the back. A pressure bar hinged to the vertical member goes on top of the lumber. The front of the pressure bar is pushed down by a brace extending to the vertical member to hold the lumber in place.

In accordance with a preferred embodiment of the invention, the rear hinge is movable vertically on the vertical member in order to allow the pressure bar to rest on to of lumber stacks having different heights. A means is provided for effectively extending the length of the brace.

In accordance with an important aspect of the invention, the extension means is a threaded shaft rotatably coupled between the brace front end and a front hinge. When the threaded shaft is rotated, the front end of the pressure bar moves with respect to the horizontal member.

In accordance with an alternative preferred embodiment, the extension means is a hydraulic piston. Operation of the piston then moves the pressure bar with respect to the horizontal member.

Other features and advantages of the present invention will become apparent from the following detailed description, taken in conjunction with the accompanying drawings, which illustrate, by way of example, the principles of the invention.

BRIEF DESCRIPTION OF DRAWINGS

FIG. 4 is an enlarged top plan view of the area within the arrow 4 of FIG. 2B with the pressure bar omitted and the handle rotated 90° for clarity of illustration;

FIG. 5 is a partial view along line 5—5 of FIG. 4 with the upper portion of the pressure bar added;

FIG. 6 is an enlarged side elevational view of the brace of FIG. 2A;

FIG. 7 is a top plan view of FIG. 6;

FIG. 8 is a view along the line 8—8 of FIG. 7;

FIG. 9 is a partial right end view of FIG. 7 from the side opposite FIG. 8;

FIG. 10 is a right end view of FIG. 6;

FIG. 11 is an enlarged side elevational view of the pressure bar of FIG. 2A;

FIG. 12 is a top plan view of FIG. 11;

FIG. 13 is a right end elevational view of FIG. 11;

MODES FOR CARRYING OUT THE INVENTION

Figure 1:
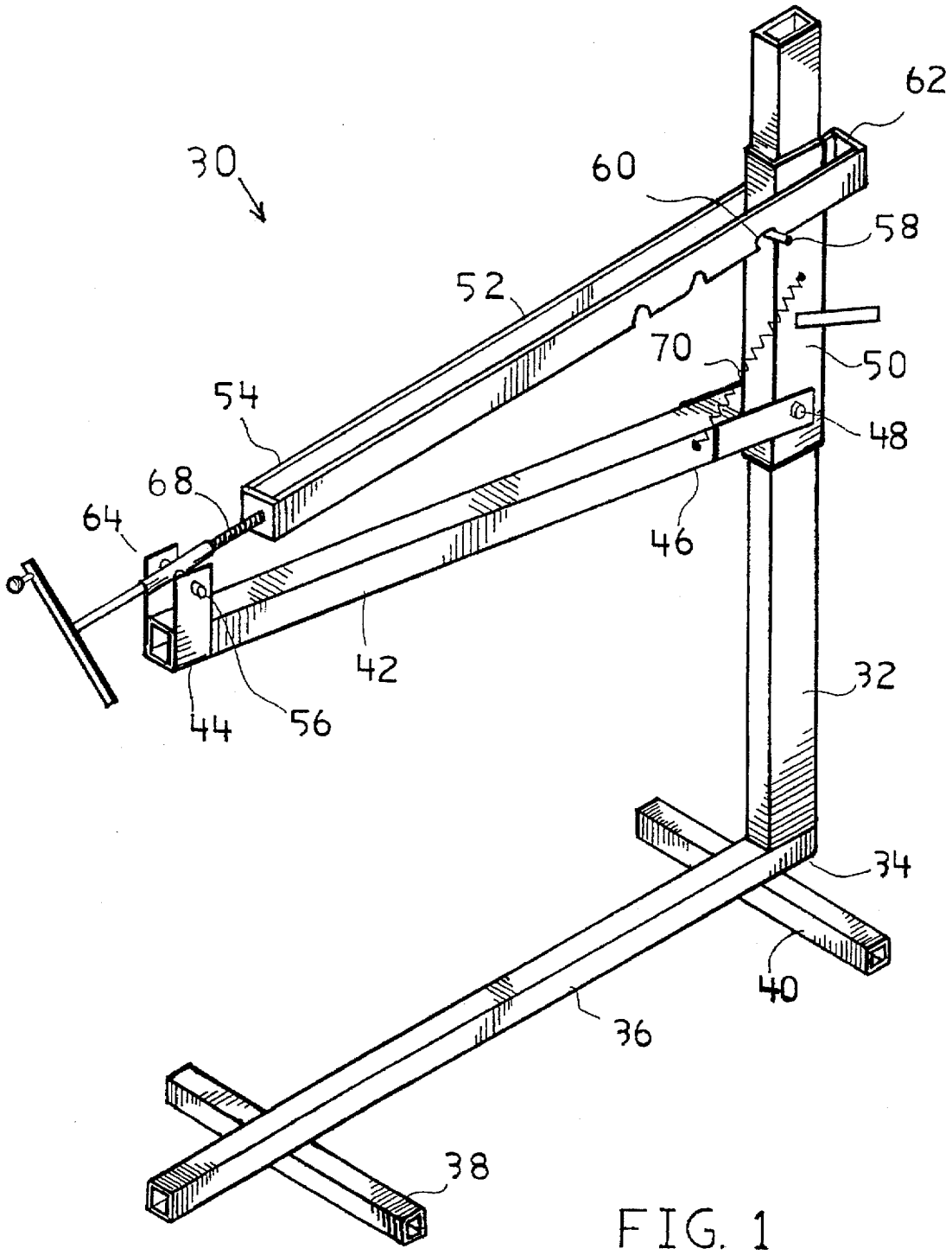
FIG. 1 is a front, top, right side, perspective view of a stacked lumber clamp in accordance with the present invention.

Referring initially to FIG. 1, a front, top, right side, perspective view of a stacked lumber clamp in accordance with the present invention, generally designated 30, is shown. The clamp 30 is preferably fabricated of steel and has a main stand including a vertical member 32 welded at a right angle to the rear end 34 of a horizontal member 36. Cross stands 38 and 40 are welded to the horizontal member 36 at right angles allowing the clamp 30 to stand upright by itself. A pressure bar 42 having front end 44 and rear end 46 is movably coupled to the vertical member 32 by a rear hinge 48 at the rear end of the pressure bar. The rear hinge is mounted on a sleeve 50 which slides on the vertical member 32 providing a means for moving the rear hinge 48 and pressure bar 42 vertically on the vertical member in order to fit different sized stacks of lumber which are positioned between the horizontal member 36 and the pressure bar 42 as shown in FIG. 2A.

Figure 2B:
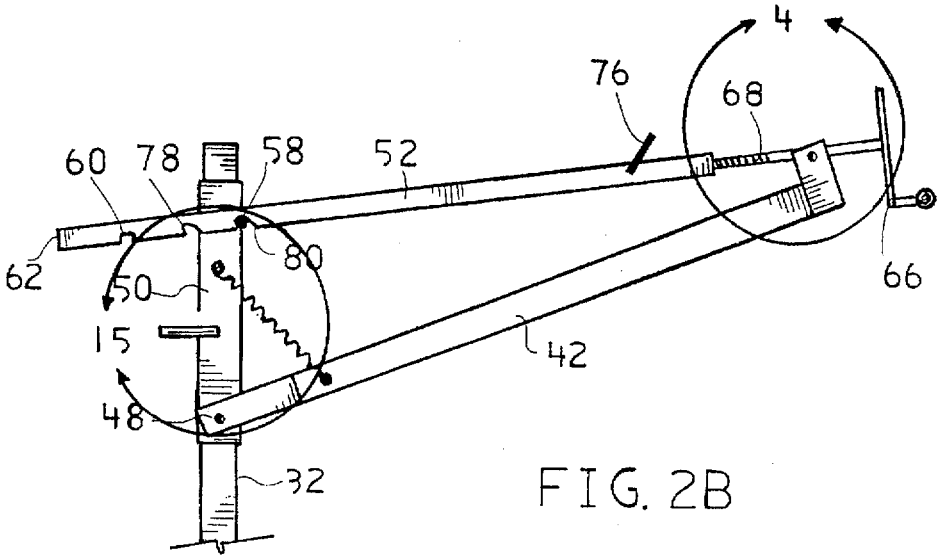
FIG. 2B is a partial left side elevational view of the upper portion of the clamp showing the pressure bar raised to release the stack of lumber of FIG. 2A.
Figure 2A:
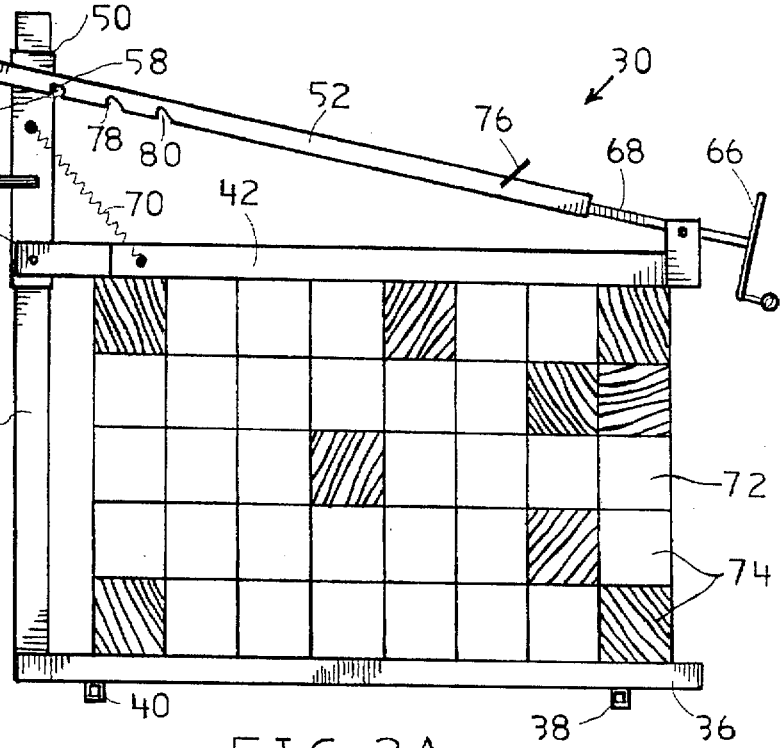
FIG. 2A is a left side elevational view of the clamp clamping a stack of lumber.

A brace 52 provides a means for holding the pressure bar 42 in a fixed position with respect to the horizontal member 36 as shown in FIG. 2A and also to lift the pressure bar off of the lumber stack when access to the lumber is desired as shown in FIG. 2B. The front end 54 of the brace 52 is coupled to the front end 44 of the pressure bar 42 by a front hinge 56. A pin 58 on the sleeve 50 and slot 60 on the underside of the brace provide a means for retaining the rear end 62 of the brace on the vertical member 32. Adjustment of the position of the pressure bar 42 with respect to the horizontal member 36 is provided by a compression crank 64 including a handle 66 and threaded shaft 68. The compression crank provides a means for extension of the brace 52 to adjusting the position of the front end 44 of the pressure bar 42 with respect to the horizontal member 36. When the clamp 30 is placed over a stack of lumber as shown in FIG. 2A and the length of the brace 52 is extended by rotation of the compression crank 64, significant clamping force is exerted on the lumber stack between the pressure bar 42 and the horizontal member 36 keeping all of the individual boards in position. When the clamp 30 is not on a lumber stack as shown in FIG. 1, a spring 70 provides a means for lifting or biasing the pressure bar front end 44 away from the horizontal member 36 facilitating insertion of the clamp around a new stack of lumber.

FIG. 2A is a left side elevational view of the clamp 30 clamping a stack of lumber 72 including individual boards 74. The height of the clamp is sufficient to allow it to be inserted around a full stack of lumber as it comes from the sawmill. Access to the boards is gained by raising the pressure bar 42 as shown in FIG. 2B. FIG. 2B is a partial left side elevational view of the upper portion of the clamp 30. As the boards are used out of the stack either at a lumberyard or construction site, the pressure bar is progressively lowered with the sleeve 50 to match the top level of the remaining boards 74.

The construction of the sleeve 50, pressure bar 42, and brace 52 provides two significant advantages to the clamp 30. The pressure bar 42 is easily released and applied to a stack of lumber by rotating the handle 66. As shown in FIG. 2A, the handle has been used to turn the threaded shaft 68 to compress the pressure bar 42 against the lumber 72. When the handle 66 is turned in the opposite direction, the pressure of the brace 52 on the pin 58 is released allowing the operator to lift the rear end 62 of the brace off of the pin 58 through the slot 60 using the hand lift 76. Aiding the operator is the spring 70 which partially compensates for the weight of the pressure bar and brace. As the pressure bar 42 pivots upward on the rear hinge 48, the lower side of the brace 52 slides along the pin 58 until the pin engages a notch 78 or a notch 80 further from the brace rear end 62 than the slot 60 to hold the pressure bar 42 away from the lumber 72 as shown in FIG. 2B.

Figure 16:
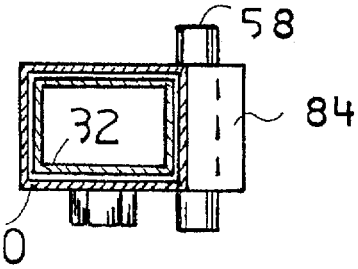
FIG. 16 is a top plan view of FIG. 15.

The other significant advantage is that the whole assembly easily moves up and down on the vertical member 32 in order to match the height of the wood stack as the height changes. The sleeve 50 is slightly larger than the vertical member 32 as shown in FIG. 16. The clearance between them allows the sleeve to be moved up and down by the operator when desired. Alternatively when the operator is no longer holding the pressure bar 42 and brace 52 and the pressure bar is not touching a stack of lumber, the sleeve 50 is canted on the vertical member 32 by the weight of the pressure bar and brace to create enough friction to hold the assembly at a fixed height on the vertical member.

The means for retaining the sleeve at a fixed position on the vertical member 32 is further facilitated by a friction member in the form of the pin 58 for pressing against the vertical member 32 when the effective length of the brace 52 is extended by the threaded shaft 68. As better shown in the enlarged view of the sleeve 50 in FIG. 15, the pin 58 touches the vertical member 32 through a slot 82 when the brace is extended. The slot 82 is sized to permit passage of the pin 58 to the vertical member during the compression of the pressure bar against a stack of lumber. When the pressure bar is no longer against a stack of lumber, the pressure bar moves down due to gravity pulling the brace and pin 58 away from the vertical member 32 into a fixed member in the form of a pin holder 84 attached to the sleeve 50 which restricts the movement of the pin away from the vertical member. The pin holder 84 and pin 58 then hold the pressure bar 42 and brace 52 in a position that easily allows the operator to move the assembly up and down on the vertical member 32 as shown in FIG. 2B.

Figure 3:
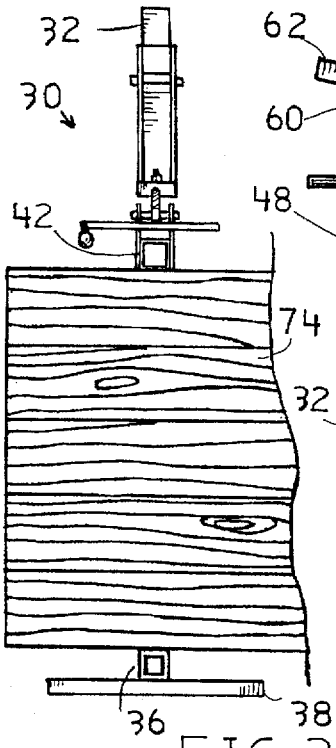
FIG. 3 is a front elevational view of FIG. 2A.

FIG. 3 is a front elevational view of FIG. 2A. The horizontal member 36, vertical member 32, and pressure bar 42 are in the same plane. The cross stand 38 holds the vertical member vertical even when the clamp 30 is not clamping a lumber stack 74.

FIG. 4 is an enlarged top plan view of the area within the arrow 4 of FIG. 2B with the pressure bar omitted and the handle rotated 90° for clarity of illustration showing the means for extension of the effective length of the brace required to compress the pressure bar against the lumber stack. The threaded shaft 68 is rotatably coupled between the brace front end 54 and the front hinge 50. The handle 60 is a hand crank that provides a means for rotating the threaded shaft in a threaded nut 86 which is welded to the brace 52 and a crank sleeve 88 welded to the front hinge 56. The threaded shaft has a threaded portion 90 that engages the threaded nut and a non-threaded portion 92 that rotates in the crank sleeve. Stops 94 and 96 attached to the threaded shaft abut the crank sleeve 88 to keep the threaded shaft 68 in place and push the pressure bar up and down.

Hasp 98 welded to the crank sleeve 88 and hasp 100 welded to the threaded shaft 68 provide a means to attach a padlock to prevent an unauthorized user from rotating the threaded shaft to gain access to the lumber stack. The clamp 30 can thereby be used to protect lumber from theft as well as to keep the lumber from twisting and bending as it dries.

FIG. 5 is a partial view along line 5—5 of FIG. 4 with the upper portion of the pressure bar 42 added. The hole 102 in hasp 98 is matched by a hole in the hasp on the threaded shaft 68 which together allow a padlock to secure the threaded shaft against unauthorized rotation.

FIGS. 6, 7, 8, 9, and 10 are various enlarged views of the brace 52 of FIG. 2A. FIG. 6 is a side elevational view, FIG. 7 is a top plan view, FIG. 8 is a view along the line 8—8 of FIG. 7, FIG. 9 is a partial right end view of FIG. 7 from the side opposite FIG. 8, and FIG. 10 is a right end view of FIG. 6.

Similarly, FIGS. 11, 12, and 13 are various enlarged views of the pressure bar 42 of FIG. 2A. FIG. 11 is a side elevational view, FIG. 12 is a top plan view, and FIG. 18 is a right end elevational view.

Figure 14:
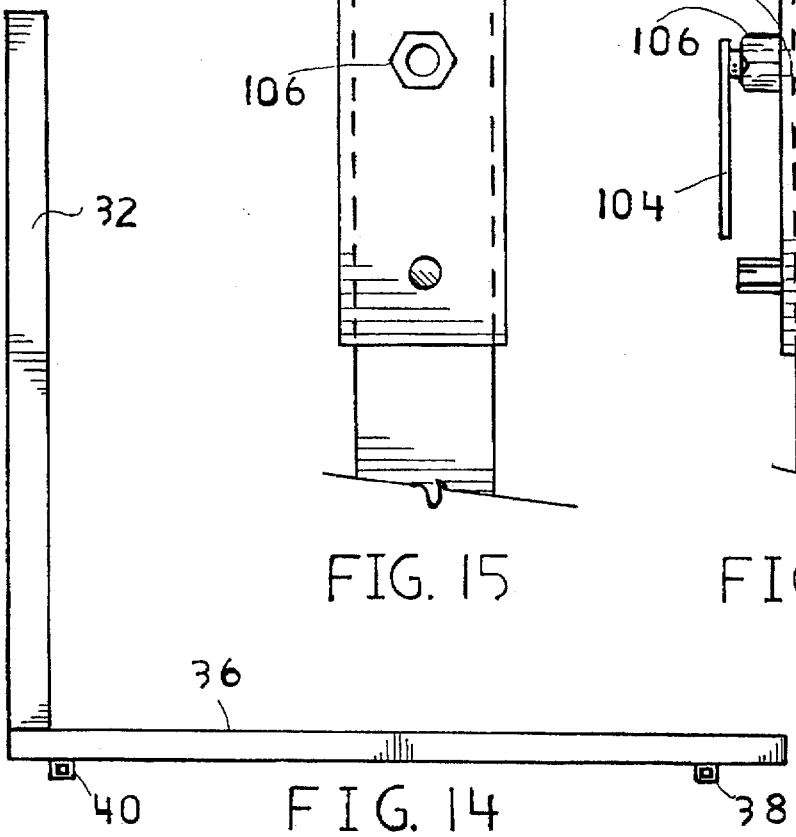
FIG. 14 is a side elevational view of the horizontal and vertical members of FIG. 2A.

FIG. 14 is a side elevational view of the main stand of the clamp showing only the horizontal and vertical members 36 and 32, respectively, and the cross stands 38 and 40.

Figure 15:
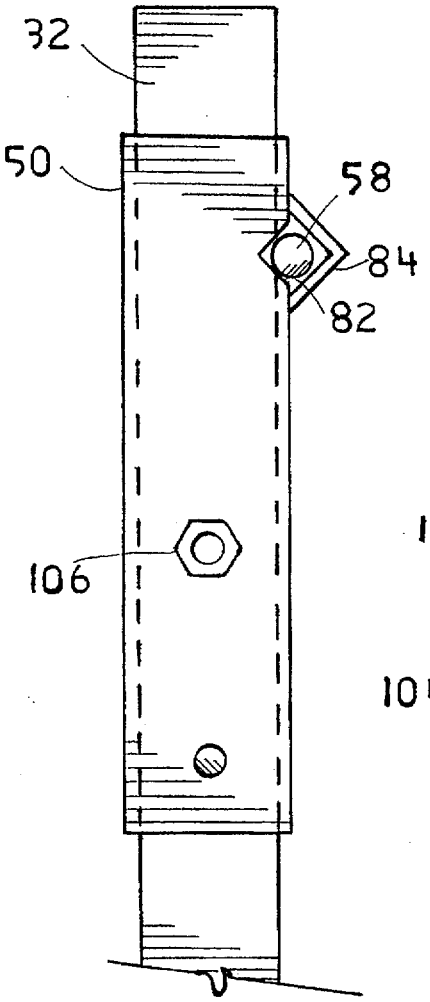
FIG. 15 is a partial enlarged view of the area within circle 15 of FIG. 2B.
Figure 17:
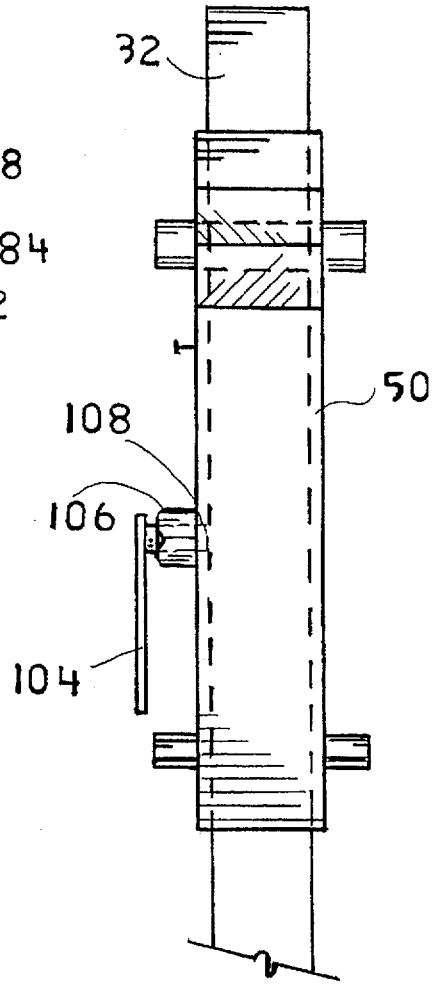
FIG. 17 is a front elevational view of FIG. 15.

FIGS. 15 is a partial enlarged view of the area within circle 15 of FIG. 2B and was discussed above in conjunction with FIGS. 2A and 2B. FIG. 16 is a top plan view of FIG. 15 and was also discussed above. FIG. 17 is a front elevational view of FIG. 15. A lock handle 104, lock handle nut 106 welded to the sleeve 50, and hole 108 through the sleeve provide a means for locking the sleeve at a desired position on the vertical member 32. The sleeve is locked at the position by rotating the lock handle into the nut until the tip 110 of the lock handle abuts the vertical member.

Figure 18:
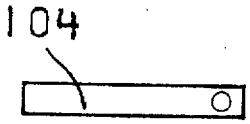
FIG. 18 is a top plan view of the lock handle of FIG. 17.
Figure 19:
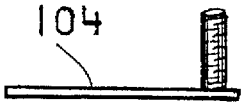
FIG. 19 is a side elevational view of FIG. 18.

FIGS. 18 and 19 show the lock handle 104 separately. FIG. 18 is a top plan view and FIG. 19 is a side elevational view.

Figure 20:
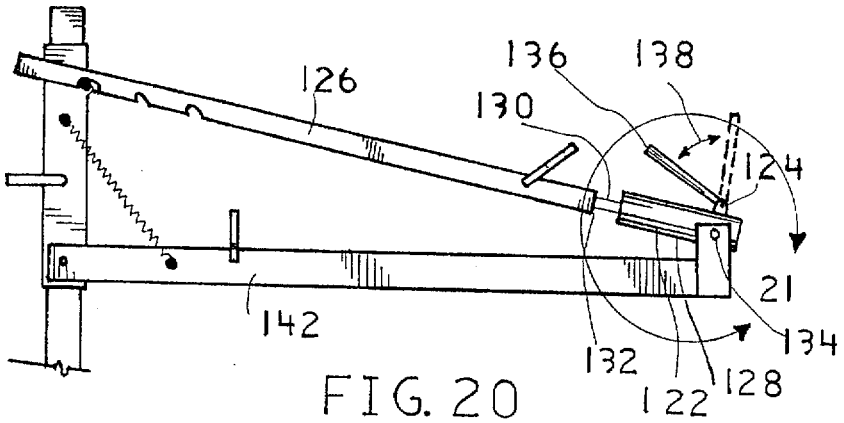
FIG. 20 is a partial side elevational view of a second hydraulic embodiment similar to FIG. 2A.

FIG. 20 is a partial side elevational view of a second hydraulic embodiment of the stacked lumber clamp, generally designated 120. The view of FIG. 20 is similar to FIG. 2A with the bottom of the main stand omitted. Elements not discusses with specific reference to FIG. 20 are the same as in FIG. 2A. A piston 122 and pump 124 provide the means for extension of the brace 126 in this embodiment and are substituted for the threaded shaft and handle of the previous embodiment. The piston includes a cylinder 128 and a piston shaft 130 having a piston shaft end 132 movable with respect to the cylinder. The piston shaft end 132 is welded to the brace 126 and the cylinder is welded to the front hinge 134. The piston would work equally well with the couplings reversed. The pump handle 136 and internal pump attached to the handle work in a manner well known in the art when moved in the arc represented by the arrow 138. When the pump handle 136 is pumped, a means is provided for moving the piston shaft end 132 with respect to the cylinder 128. The pump is preferable a hydraulic pump but could be any means for creating hydraulic pressure to move the piston shaft end. Pneumatic pressure could also be use.

Figure 21:
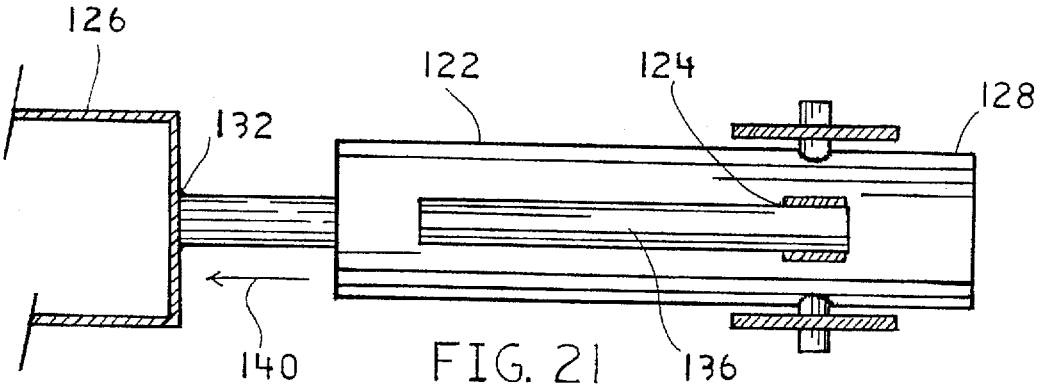
FIG. 21 is an enlarged top plan view of the area within arrow 21 of FIG. 20 with the pressure bar omitted for clarity of illustration.

FIG. 21 is an enlarged top plan view of the area within arrow 21 of FIG. 20 with the pressure bar omitted for clarity of illustration. The view is similar to FIG. 4 with respect to function. The piston 122 and pump 124 provide a means for extension of the effective length of the brace 126. The piston shaft end 132 is welded to the brace 126 and the cylinder is welded to the front hinge 134. When the handle 136 is pumped, the brace 126 moves away from the piston 122 in the direction of the arrow 140.

Figure 22:
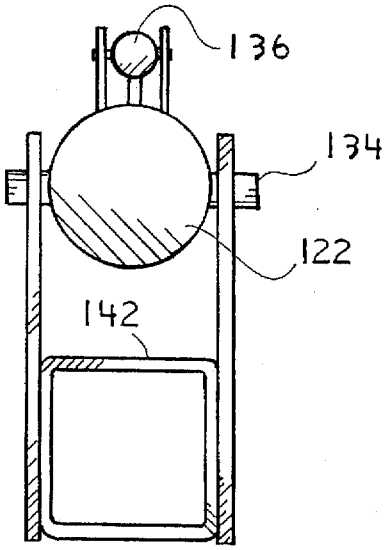
FIG. 22 is a partial front elevational view of FIG. 20.

FIG. 22 is a partial front elevational view of FIG. 20 showing the pressure arm 142, piston 122, pump handle 136, and front hinge 134.

Figure 23:
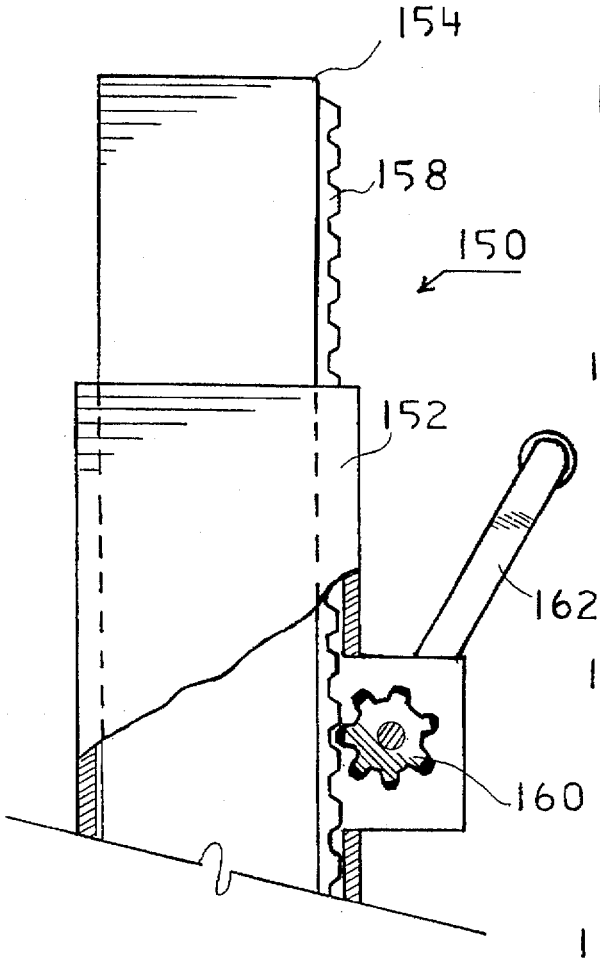
FIG. 23 is an enlarged cutaway side elevational view of a rack and pinion embodiment substituting for the pin embodiment shown in FIG. 15; and, FIG. 24 is a cutaway front elevational view of FIG. 23.
Figure 24:
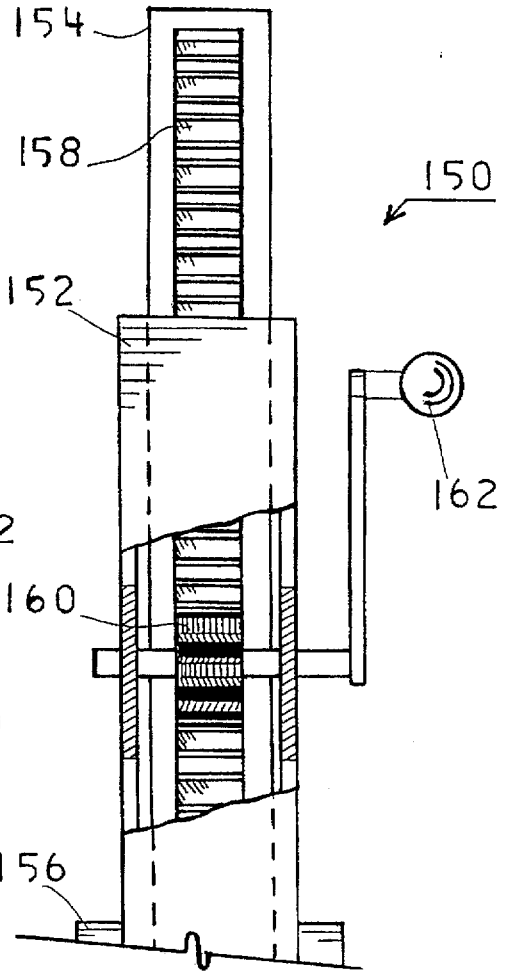

FIG. 23 is an enlarged cutaway side elevational view of a rack and pinion embodiment 150 for holding the sleeve at a desired position on the vertical member substituting for the pin embodiment for holding the sleeve shown in FIG. 15. FIG. 24 is a cutaway front elevational view of FIG. 23. As in the previous embodiments, a sleeve 152 provides a movable member on the vertical member 154 that is coupled to a rear hinge 156 for moving the rear hinge along the vertical member to adjust for the varying heights of the stacked lumber. The rack 158 is welded to the vertical member 154 and the pinion 160 is rotatably mounted to the sleeve 152. As the pinion crank 162 is rotated, the pinion 160 moves up or down the rack 158 moving the sleeve 152 thereby providing a means for selectively moving the rear hinge 156 vertically on the vertical member.

The preferred embodiments of the invention described herein are exemplary and numerous modifications, dimensional variations, and rearrangements can be readily envisioned to achieve an equivalent result, all of which are intended to be embraced within the scope of the appended claims.

I claim:

1. A clamp for a stack of lumber, comprising:

a horizontal member having front and rear ends;

a vertical member coupled to said rear end of said horizontal member;

a pressure bar having front and rear ends;

a rear hinge movably coupling said rear end of said pressure bar to said vertical member; and, means for holding said pressure bar in a fixed position with respect to said horizontal member including a brace between said vertical member and said pressure bar.

2. A lumber stack clamp according to claim 1, wherein said vertical member is rigidly coupled to said horizontal member at substantially right angles to said horizontal member.

3. A lumber stack clamp according to claim 1, further including a means for selectively moving said rear hinge vertically on said vertical member.

4. A lumber stack clamp according to claim 1, wherein said holding means further includes:

said brace having front and rear ends;

a front hinge coupled between said brace and said pressure bar adjacent said brace and pressure bar front ends; and, a means for retaining said brace rear end on said vertical member.

5. A lumber stack clamp according to claim 4, wherein said holding means further includes a means for extension of said brace for adjusting the position of said front end of said pressure bar with respect to said horizontal member.

6. A lumber stack clamp according to claim 5, wherein said extension means includes:

a threaded shaft rotatably coupled between said brace front end and said front hinge; and, a means for rotating said threaded shaft to move said front end of said pressure bar with respect to said horizontal member.

7. A lumber stack clamp according to claim 6, wherein said extension means further includes:

a threaded nut coupled to said brace;

a crank sleeve coupled to said front hinge; and, said threaded shaft having:

a threaded portion in said threaded nut;

a non-threaded portion in said crank sleeve; and, a stop at said crank sleeve.

8. A lumber stack clamp according to claim 7, wherein said rotating means is a hand crank.

9. A lumber stack clamp according to claim 5, wherein said extension means includes:

a piston having a cylinder and a piston shaft end movable with respect to said cylinder;

said piston shaft end coupled to one of said front hinge and said brace;

said cylinder coupled to the other of said front hinge and said brace; and, means for moving said piston shaft end with respect to said cylinder.

10. A lumber stack clamp according to claim 9, wherein said moving means includes hydraulic pressure creation means for moving said piston shaft end relative to said cylinder.

11. A lumber stack clamp according to claim 5, wherein said retaining means includes a friction member for pressing against said vertical member when said extension means is extended to hold said retaining means at a fixed position on said vertical member.

12. A lumber stack clamp according to claim 11, wherein said retaining means further includes:

said friction member having a pin; and, a pin holder for said pin movable vertically on said vertical member.

13. A lumber stack clamp according to claim 12, wherein said pin holder includes:

a slot sized to permit passage of said pin to said vertical member during compression of said pressure bar; and, a fixed member on said pin holder restricting movement of said pin away from said vertical member when pressure bar is not under compression.

14. A lumber stack clamp according to claim 12, wherein said means for holding said brace further includes said brace having:

a slot adjacent said brace rear end for selectively engaging said pin; and, at least one notch further from said brace rear end than said slot for selectively engaging said pin.

15. A lumber stack clamp according to claim 1, further including a means for biasing said pressure bar front end away from said horizontal member.

16. A lumber stack clamp according to claim 1, wherein said horizontal member, vertical member, and said pressure bar are all substantially in the same plane, and further comprising at least one cross stand coupled to said horizontal member at substantially right angles to said horizontal member for holding said vertical member vertical.

17. A lumber stack clamp according to claim 3, wherein said means for selectively moving said rear hinge includes a rack coupled to said vertical member and a sleeve having a pinion rotatably coupled thereto and operating with said rack to move said rear hinge vertically on said vertical member.

* * * * *